United States Patent [19]
Satoh et al.
[11] 4,318,203
[45] Mar. 9, 1982

[54] SINGLE-HANDED OPERATION TYPE SCAVENGING BLOWER

[75] Inventors: Masatoshi Satoh, Tokyo; Yoetsu Yokocho, Tachikawa, both of Japan

[73] Assignee: Kioritz Corporation, Japan

[21] Appl. No.: 170,315

[22] Filed: Jul. 18, 1980

[30] Foreign Application Priority Data

Aug. 10, 1979 [JP] Japan ..... 54-109578[U]

[51] Int. Cl.[3] ..... A47L 5/14
[52] U.S. Cl. ..... 15/344; 15/405; 417/364
[58] Field of Search ..... 15/344, 405, 406, 410; 417/364

[56] References Cited

U.S. PATENT DOCUMENTS 1,583,528 5/1926 Clements ..... 15/405 X
1,666,350 4/1928 Pitt ..... 15/405 X
2,598,499 5/1952 Breuer et al. ..... 15/405 X
4,132,507 1/1979 Akiyama et al. ..... 417/364
4,223,419 9/1980 Sato et al. ..... 15/405

OTHER PUBLICATIONS

Washington Star, Sep. 23, 1977, "Look, Up in the Sky!".

*Primary Examiner*—Chris K. Moore
*Attorney, Agent, or Firm*—Karl W. Flocks; A. Fred Starobin

[57] ABSTRACT

A scavenging blower includes a fan driven by an air-cooled, two-cycle engine for blowing air through an air discharging port. The fan is housed in a fan chamber disposed in side-by-side relation to the engine, and an air passageway is formed around a crankcase of the engine and a fuel tank is located beneath the engine. A handle gripped by one hand is attached to the outer periphery of the fan chamber so that the blower can be operated single-handed.

2 Claims, 4 Drawing Figures

SINGLE-HANDED OPERATION TYPE SCAVENGING BLOWER

BACKGROUND OF THE INVENTION

1. Field of the Invention

This invention relates to scavenging blowers, and more particularly it is concerned with a single-handed operation type scavenging blower suitable for household use that can be readily transported and operated and stored in a narrow space when not in service, the scavenging blower being operative to remove rubbish or dirt, such as fallen leaves, from gardens or pavements or dispersing pools of water after rainfalls.

2. Description of the Prior Art

Generally, a scavenging blower provided with an engine is carried on a person's back or hung from a person's shoulder even if it is small in size, and no scavenging blowers that can be handled single-handed have ever been developed and put to practical use. This inability to produce a single-handed operation type scavenging blower is mainly attributed to the difficulty with which a compact size and a light weight are obtained in an engine which is a power source and a fan which sets up a current of air.

SUMMARY OF THE INVENTION

This invention has as one of its objects the provision of a scavenging blower provided with an engine which is suitable for household use and capable of being operated single-handed, by making use of compact, air-cooled, two-cycle engine technology that has made a remarkable progress in recent years and a synthetic resin which has enabled material of light weight and increased strength to be obtained.

Another object is to provide a single-handed operation type scavenging blower which is reduced in the number of parts and capable of being operated single-handed with ease because of its compact size and light weight.

Characterizing features of the invention include the structural arrangement whereby an air-cooled, two-cycle engine and a centrifugal fan chamber are disposed in adjacent relationship to reduce the number of parts at their boundary, an air passageway and a fuel tank are located in a position beneath the engine to lower the center of gravity, and a handle that can be gripped single-handed is provided at the outer periphery, so that the scavenging blower of compact size and light weight can be operated without any trouble.

DESCRIPTION OF THE PREFERRED EMBODIMENTS

Figure 1:
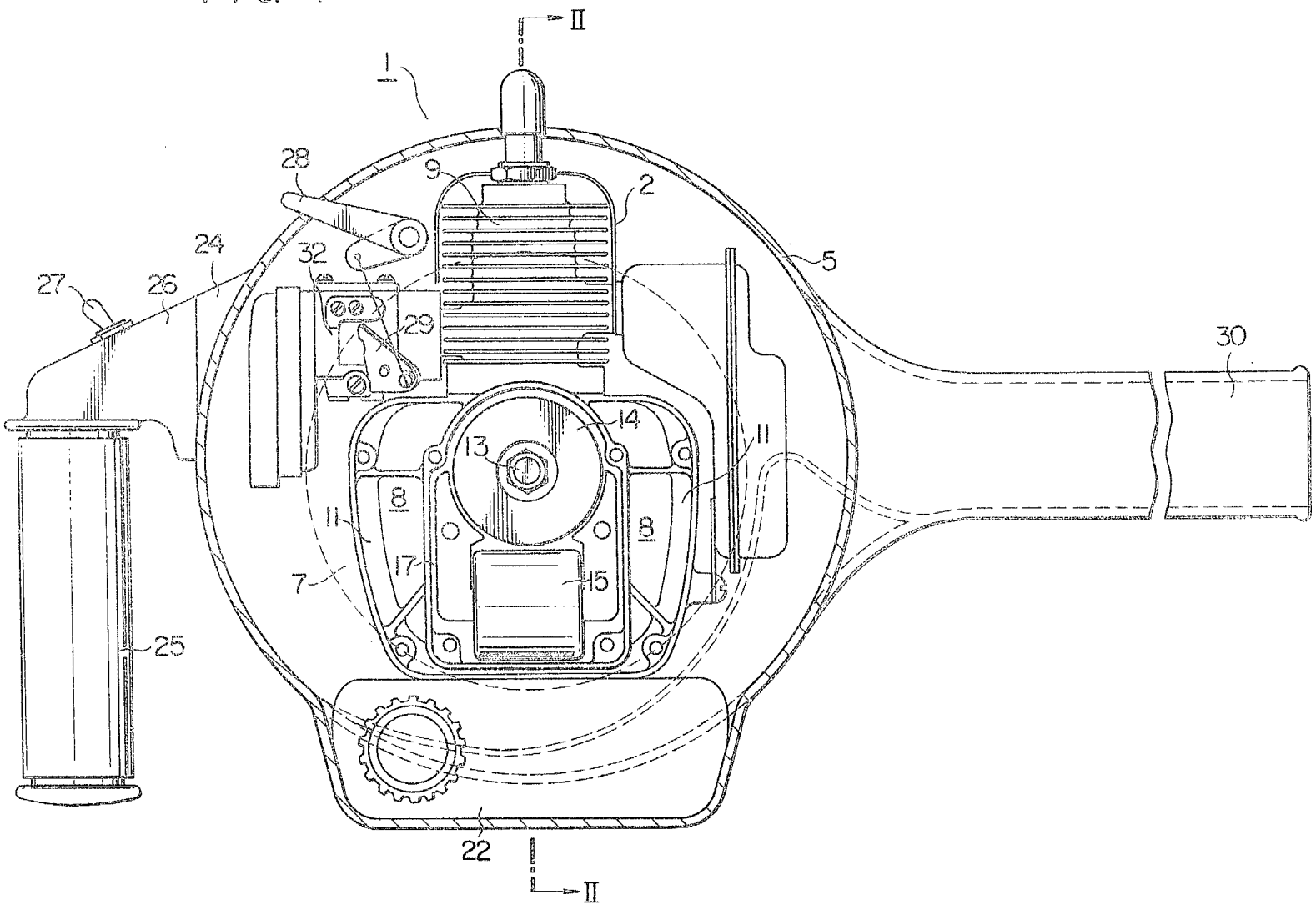
FIG. 1 is a side view, with the cover being removed, of the single-handed operation type scavenging blower comprising one embodiment of the invention.
Figure 2:
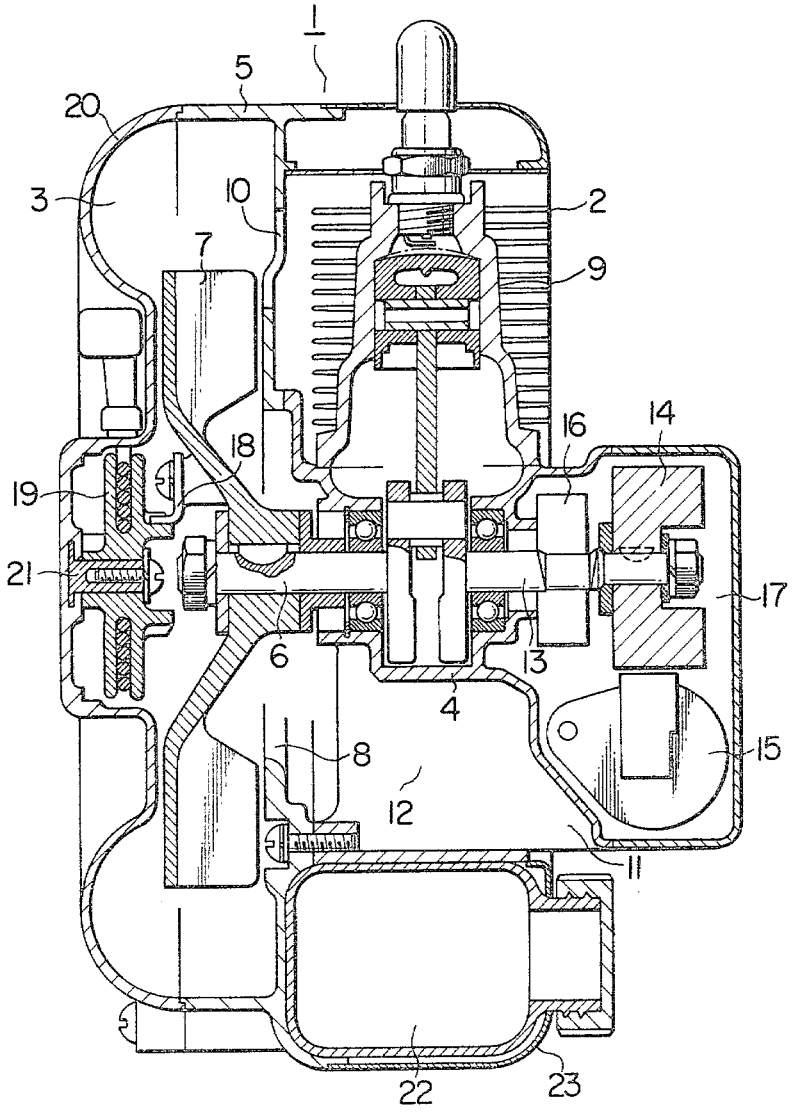
FIG. 2 is a sectional view taken along the line II—II in FIG. 1.

Preferred embodiments of the invention will now be described by referring to the accompanying drawings.

A scavenging blower 1 according to the invention comprises an air-cooled, two-cycle engine 2 formed in adjacent relation to a centrifugal fan chamber 3 in a unitary structure. An inner wall 5 of the centrifugal fan chamber 3 is secured to one side of an engine crankcase 4, and a fan 7 disposed in the fan chamber 3 is supported by one end of a crank-shaft 6 of the engine 2 for rotation therewith. The inner wall 5 of the fan chamber 3 is formed around a fan boss with an opening 8 serving as an air intake port. Another opening 10 is formed in the inner wall 5 in a position near a head of an engine cylinder 9 so as to blow pressurized air from the fan chamber 3 against the cylinder 9 to effect cooling thereof.

An air passageway 12 surrounding the crankcase 4 of the engine 2 and venting to atmosphere through an opening 11 is maintained in communication with the opening 8 formed in the inner wall 5 of the fan chamber 3. Another end of the crank-shaft 13 of the engine 2 has secured thereto an igniting device disposed in an electricqal igniting device chamber 17. The igniting device comprises a rotary magnetic member 14 secured to the end of the crankshaft 13, a generating coil 15 attached to the outer periphery of the rotary magnetic member 14 and an igniting contact member 16 mounted on the end of the crankshaft 13 and synchronously operated by a cam of the crankshaft.

The fan 7 in the fan chamber 3 has secured to the outer side of an arm a pawl 18 for starting the engine 2 which is adapted to come into and be released from locking engagement with a cord pulley 19 of a recoil starter supported on a stub shaft 21 connected to the inner side of an outer wall 20 of the fan chamber 3.

A fuel tank 22 is secured by extending the inner wall 5 of the fan chamber 3 and shaping same into a tank form so that the fuel tank 22 is disposed beneath the engine 2. A cover 23 is attached to the outer side of the fuel tank 22 and the engine 2.

By this constructional arrangement, the scavenging blower 1 substantially circular in shape can have its engine 2 and the fan 7 packaged in a compact form.

Figure 3:
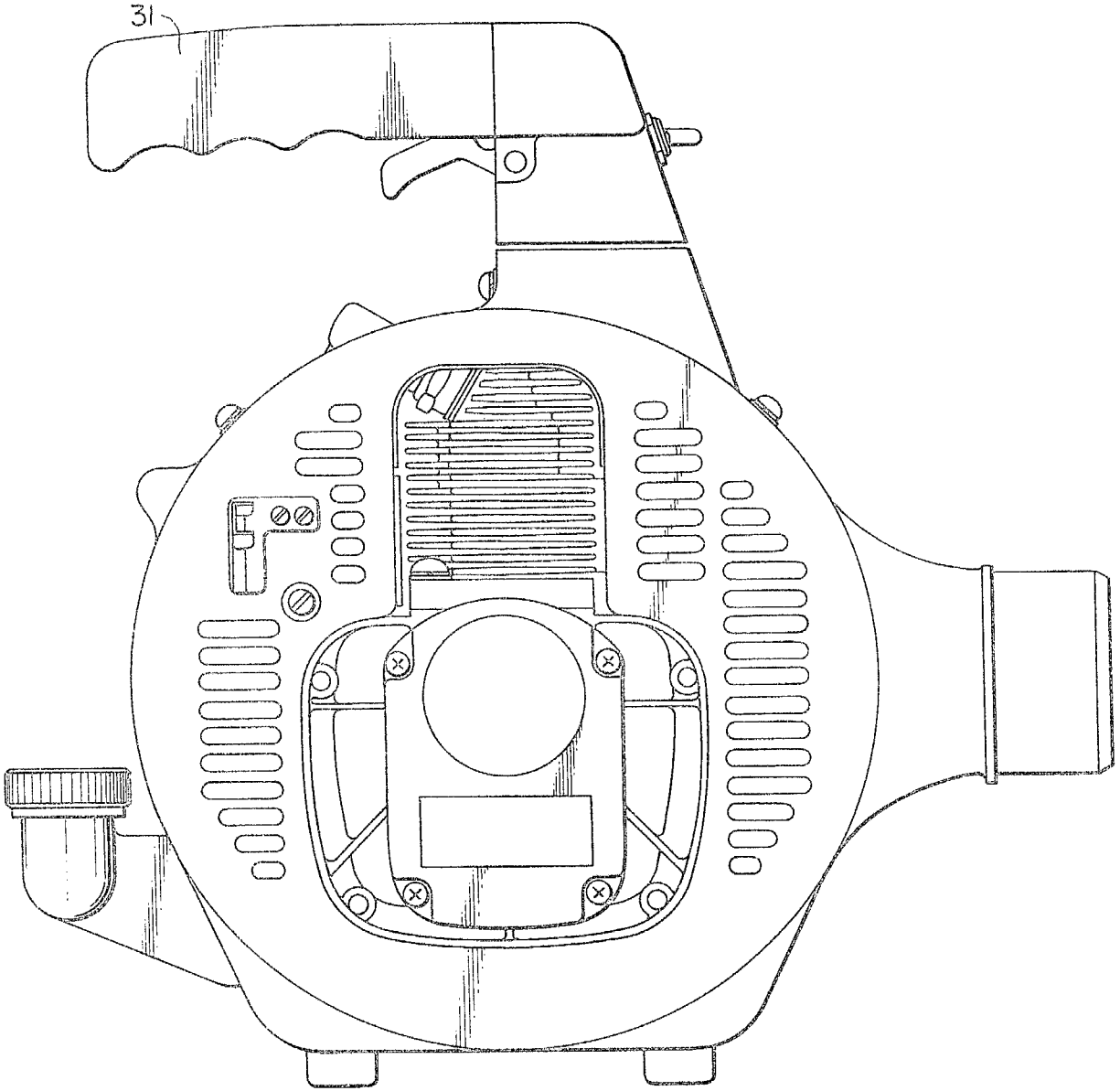
FIGS. 3 and 4 are a side view and a back view respectively of the single-handed operation type scavenging blower comprising another embodiment of the invention.
Figure 4:
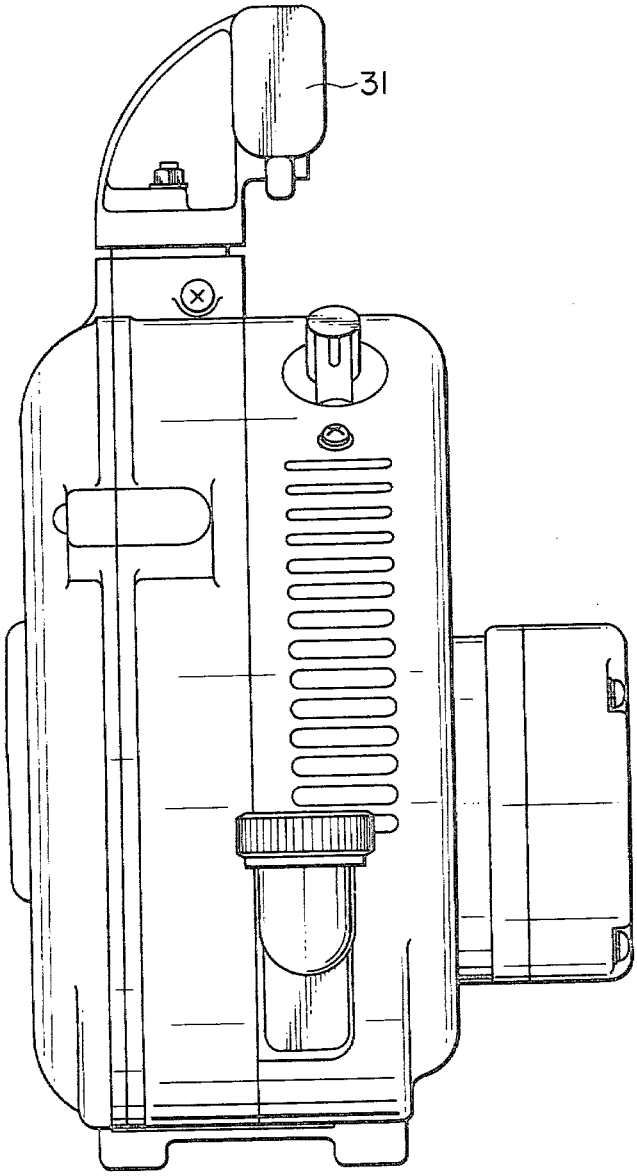

As shown in FIG. 1, a seat 24 is formed at one side of the outer periphery of an upper portion of the scavenging blower 1 and has mounted thereon a mounting portion 26 for supporting a handle 25 which can be gripped by a hand. The position in which the handle 25 is supported may vary depending on the use for which the scavenging blower 1 is intended. For example, a handle 31 shown in FIGS. 3 and 4 is located in the upper portion of the scavenging blower. In cases where it is necessary to avoid propagation of vibration of the engine 2, a vibration absorbing member formed of rubber or other suitable material may be attached to the connection of the handle to the mounting portion.

Referring to FIG. 1 again, the scavenging blower 1 is formed with an air discharging port 30 of the fan chamber 3 in a position opposite the handle 25. The air discharging port 30 which projects from the blower 1 may be formed to have a nozzle tube of any size and shape as desired connected to its end. Such nozzle tube may have a grip attached thereto, so that the scavenging blower 1 can be supported by both hands instead of by one hand, if desired.

An electrical switch 27 for starting and stopping the blower 1 is attached to the mounting portion 26. Levers 28 and 29 are connected in suitable positions for operating the throttle valve of a carburetor 32. However, the levers may, of course, be connected to the handle 25 for the sake of ease and safety of operation.

The engine 2 which is a compact, air-cooled, two-cycle engine has a cylinder volume of about 15 to 20 cc and a weight of about 2.5 kg. When the engine 2 is formed into a unitary structure with the fan 7 formed of a synthetic resin, the total weight of the unitary structure is about 3.5 kg and the blower 1 can be handled single-handed with ease to discharge an air current of about 6.0 $M^3$/min. The air current of this volume is enough to clear the lawn of dry fallen leaves and the pavement of rubbish and dirt of large size by blowing them away, so that the blower 1 contributes to reduced time and labor required for clearing the ground and increased efficiency in operation. It is expected that the scavenging blower according to the invention will have increased applications.

What is claimed is:

1. A single-handed operation type scavenging blower comprising:

a fan in a fan chamber;

an air-cooled, two-cycle engine for driving said fan;

a handle gripped by one hand; and an air discharging port; wherein the improvement resides in the arrangement whereby said engine is arranged in side-by-side relation to said fan chamber and formed in a unitary structure, and said handle and said air discharging port project outwardly from the outer periphery of the fan chamber; said scavenging blower further comprising an inner wall of said fan chamber and a crankcase of said engine secured to each other as a unit, an air passageway formed around said crankcase, an opening formed in said inner wall in a manner to surround a boss of said fan and communicating with said air passageway, and a fuel tank for supplying fuel to said engine disposed beneath said air passageway.

2. A single-handed operation type scavenging blower as claimed in claim 1 further comprising a starting device for said engine mounted on an outer wall cooperating with said inner wall to define said fan chamber.

* * * * *